US005912223A

United States Patent [19]

Drapier

[11] Patent Number: 5,912,223

[45] Date of Patent: Jun. 15, 1999

[54] MICROEMULSION LIGHT DUTY LIQUID CLEANING COMPOSITIONS

[75] Inventor: Julien Drapier, Seraing, Belgium

[73] Assignee: Colgate Palmolive Company, New York, N.Y.

[21] Appl. No.: 09/056,098

[22] Filed: Apr. 7, 1998

Related U.S. Application Data

[63] Continuation-in-part of application No. 08/896,243, Jul. 17, 1997, Pat. No. 5,840,676, which is a continuation-in-part of application No. 08/714,435, Sep. 16, 1996, abandoned, which is a continuation-in-part of application No. 08/526,785, Sep. 11, 1995, Pat. No. 5,580,848, which is a continuation-in-part of application No. 08/356,615, Dec. 15, 1994, Pat. No. 5,529,723.

[51] Int. Cl.[6] ..... C11D 1/04; C11D 1/29; C11D 1/94; C11D 3/28

[52] U.S. Cl. ..... 510/417; 510/423; 510/424; 510/428; 510/432; 510/433; 510/501

[58] Field of Search ..... 510/417, 423, 510/424, 428, 432, 433, 501

[56] References Cited

U.S. PATENT DOCUMENTS

| | | | |
|---|---|---|---|
| 5,108,643 | 4/1992 | Loth et al. | 252/174.11 |
| 5,252,245 | 10/1993 | Garabedian, Jr. et al. | 252/153 |
| 5,486,307 | 1/1996 | Misselyn et al. | 252/174.24 |
| 5,529,723 | 6/1996 | Drapier | 252/550 |
| 5,534,200 | 7/1996 | Erilli et al. | 510/396 |
| 5,580,848 | 12/1996 | Drapier | 510/417 |
| 5,840,676 | 11/1998 | Drapier | 510/417 |

*Primary Examiner*—Mark Kopac
*Assistant Examiner*—Gregory R. Delcotto
*Attorney, Agent, or Firm*—Richard E. Nanfeldt

[57] ABSTRACT

A microemulsion light duty liquid detergent with desirable cleansing properties and mildness to the human skin comprising: a water soluble nonionic surfactant, a $C_{8-18}$ ethoxylated alkyl ether sulfate anionic surfactant, a sulfonate or sulfonate anionic surfactant, and a betaine surfactant, and optionally an alkyl monoalkanol amide.

9 Claims, No Drawings

MICROEMULSION LIGHT DUTY LIQUID CLEANING COMPOSITIONS

RELATED APPLICATION

This application is a continuation in part of U.S. Ser. No. 8/896,243 filed Jul. 17, 1997, now U.S. Pat. No. 5,840,676, which in turn is a continuation in part application of U.S. Ser. No. 714,435 filed Sep. 16, 1996, now abandoned, which in turn is a continuation in part application of U.S. Ser. No. 8/526,785 filed Sep. 11, 1995, now U.S. Pat. No. 5,580,848, which in turn is a continuation in part application of U.S. Ser. No. 8/356,615 filed Dec. 15, 1994, now U.S. Pat. No. 5,529,723.

FIELD OF INVENTION

This invention relates to a light duty liquid cleaning composition which imparts mildness to the skin and is in the form of a microemulsion designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist s efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

U.S. Pat. No. 5,082,584 discloses a microemulsion composition having an anionic surfactant, a cosurfactant, nonionic surfactant, perfume and water; however, these compositions are not light duty liquid compositions.

The present invention relates to novel microemulsion light duty liquid detergent compositions with high foaming properties, containing a nonionic surfactant, a sulfonate surfactant, a betaine surfactant, and an ethoxylated alkyl ether sulfate surfactant. The compositions may also optionally contain from 0 to 5% of an alkyl monoalkanol amide and/or an alkyl dialkanol amide.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major active ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water but fails to disclose an alkyl polysaccharide surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a microemulsion foaming, liquid detergent composition containing a nonionic surfactant, a supplementary high foaming anionic sulfonate surfactant, a betaine surfactant, and an ethoxylated alkyl ether sulfate surfactant and a water insoluble hydrocarbon or perfume as the essential ingredients and optionally an alkyl monoalkanol amide such as an alkanol monoethanol amide (LMMEA), and the composition does not contain any abrasives, silicas, alkaline earth metal carbonates, alkyl glycine surfactant, cyclic imidinium surfactant, alkali metal carbonates or more than 3 wt. % of a fatty acid or its salt thereof, a nitrogenous buffer selected from the group consisting of ammonium or alkaline carbonates, quanidine derivatives, alkoxyl alkylamines, and alkyleneamines, and a grease release agent which is an ethoxylated maleic anhydride-alpha-olefin copolymer having a comb like structure with both hydrophobic and hydrophilic chains and the copolymer is characterized by the formula:

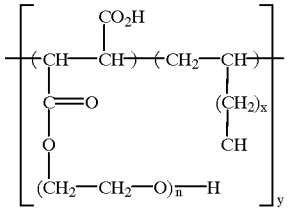

wherein n is about 5 to about 14, x is about 7 to 19, and y is of such a value as to provide a molecular weight about 10,000 to about 30,000.

SUMMARY OF THE INVENTION

It has now been found that a microemulsion light duty liquid detergent can be formulated with a nonionic surfactant which has desirable cleaning properties, mildness to the human skin.

An object of this invention is to provide a novel microemulsion light duty liquid detergent composition containing a nonionic surfactant, a betaine surfactant, a sulfate or sulfonate anionic surfactant and an ethoxylated alkyl ether sulfate surfactant and optionally an alkyl monoalkanol amide, wherein the composition does not contain any silicas, abrasives, alkali metal carbonates, alkaline earth metal carbonates, alkyl glycine surfactant, cyclic imidinium surfactant, or more than 3 wt. % of a fatty acid or salt thereof.

Another object of this invention is to provide a novel microemulsion light duty liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming microemulsion light duty liquid detergent of this invention comprises four essential surfactants: a water soluble, ethoxylated, nonionic surfactant, a betaine surfactant, an ethoxylated alkyl ether sulfate surfactant and a sulfate or sulfonate anionic surfactant and optionally an alkyl monoalkanol amide as well as a cosurfactant, a water insoluble hydrocarbon and water, wherein the composition does not contain any silicas, abrasives, alkali metal carbonates, alkaline earth metal carbonates, alkyl glycine surfactant, cyclic imidinium surfactant or more than 3 wt. % of a fatty acid or salt thereof, a nitrogenous buffer selected from the group consisting of ammonium or alkaline carbonates, quanidine derivatives, alkoxyl alkylamines, and alkyleneamines, and a grease release agent which is an ethoxylated maleic anhydride-alpha-olefin copolymer having a comblike structure with both hydrophobic and hydrophilic chains and the copolymer is characterized by the formula:

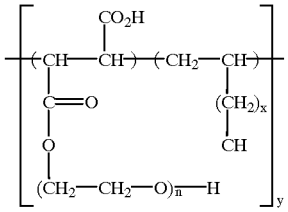

wherein n is about 5 to about 14, x is about 7 to 19, and y is of such a value as to provide a molecular weight about 10,000 to about 30,000.

DETAILED DESCRIPTION OF THE INVENTION

The microemulsion light duty liquid compositions of the instant invention comprise approximately by weight:

(a) 10% to 24% of an alkali metal salt of a $C_{12-18}$ paraffin sulfonate;

(b) 2% to 6% of an alkali metal salt of a $C_{8-18}$ ethoxylated alkyl ether sulfate;

(c) 2% to 8% of a betaine surfactant;

(d) 2% to 14% of a nonionic surfactant;

(e) 1% to 10% of at least one solubilizing agent;

(f) 1% to 14% of at least one cosurfactant;

(g) 0 to 10% of a supplemental solubilizing agent;

(h) 1% to 8% of a water insoluble saturated or unsaturated organic compound having 4 to 20 carbon atoms;

(i) 0 to 5%, more preferably 0.5% to 4.5% of an alkyl monoalkanol; and (j) the balance being water.

The instant compositions do not contain any grease release agents such as choline chloride or buffering system which is a nitrogenous buffer which is ammonium or alkaline earth carbonate, guanidine derivates, alkoxylalkyl amines and alkyleneamines and the composition is pourable and not a gel has a complex viscosity at 1 $rads^{-1}$ of less than 0.4 Pascal seconds.

The nonionic surfactant is present in amounts of about 4 to 12%, preferably 4% to 10% by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 7 to 10 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The anionic sulfonate surfactants which may be used in the detergent of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate present in the composition at a concentration of about 14% to 24 wt. %, more preferably 15% to 22%.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sultonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium. The ethoxylated alkyl ether sulfate is present in the composition at a concentration of about 2.0 to about 5.0 wt. %, more preferably about 2.5% to 4.5 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The water-soluble zwitterionic surfactant (betaine), which is also an essential ingredient of present microemulsion light duty liquid detergent composition, constitutes about 2% to 8%, preferably 3% to 6%, by weight and provides good foaming properties and mildness to the present nonionic based liquid detergent. The zwitterionic surfactant is a water soluble betaine having the general formula:

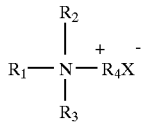

wherein $X^-$ is selected from the group consisting Of $SO_3$— and $CO_2$— and $R_1$ is an alkyl group having 10 to about 20 carbon atoms, preferably 12 to 16 carbon atoms, or the amido radical:

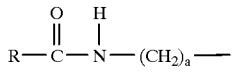

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The water insoluble saturated or unsaturated organic compounds contain 4 to 20 carbon atoms and up to 4 different or identical functional groups and is used at a concentration of about 1.0 wt. % to about 8 wt. %, more preferably about 2.0 wt. % to about 7 wt. %. Examples of acceptable water insoluble saturated or unsaturated organic compound include (but are not limited to) water insoluble hydrocarbons containing 0 to 4 different or identical functional groups, water insoluble aromatic hydrocarbons containing 0 to 4 different or identical functional groups, water insoluble heterocyclic compounds containing 0 to 4 different or identical functional groups, water insoluble ethers containing 0 to 3 different or identical functional groups, water insoluble alcohols containing 0 to 3 different or identical functional groups, water insoluble amines containing 0 to 3 different or identical functional groups, water insoluble esters containing 0 to 3 different or identical functional groups, water insoluble carboxylic acids containing 0 to 3 different or identical functional groups, water insoluble amides containing 0 to 3 different or identical functional groups, water insoluble nitriles containing 0 to 3 different or identical functional group, water insoluble aldehydes containing 0 to 3 different or identical functional groups, water insoluble ketones containing 0 to 3 different or identical functional groups, water insoluble phenols containing 0 to 3 different or identical functional groups, water insoluble nitro compounds containing 0 to 3 different or identical functional groups, water insoluble halogens containing 0 to 3 different or identical functional groups, water insoluble sulfates or sulfonates containing 0 to 3 different or identical functional groups, limonene, dipentene, terpineol, essential oils, perfumes, water insoluble organic compounds containing up to 4 different or identical functional groups such as an alkyl cyclohexane having both three hydroxys and one ester group and mixture thereof.

Typical heterocyclic compounds are 2,5-dimethylhydrofuran,2-methyl-1,3-dioxolane, 2-ethyl 2-methyl 1,3 dioxolane, 3-ethyl 4-propyl tetrahydropyran, 3-morpholino-1,2-propanediol and N-isopropyl morpholine A typical amine is alpha-methyl benzyldimethylamine. Typical halogens are 4-bromotoluene, butyl chloroform and methyl perchloropropane. Typical hydrocarbons are 1,3-dimethylcyclohexane, cyclohexyl-1 decane, methyl-3 cyclohexyl-9 nonane, methyl-3 cyclohexyl-6 nonane, dimethyl cycloheptane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene and methyl naphthalene. Typical water insoluble esters are benzyl acetate, dicyclopentadienylacetate, isononyl acetate, isobornyl acetate and isobutyl isobutyrate. Typical water insoluble ethers are di(alphamethyl benzyl) ether and diphenyl ether. Typical alcohols are phenoxyethanol and 3-morpholino-1,2-propanediol. Typical water insoluble nitro derivatives are nitro butane and nitrobenzene.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl sovalerate, Hexyl-2-methylbutyrate, Hydroxycitronellal, lonone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo lonone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™.

The instant compositions contain about 1 wt. % to about 10 wt. %, more preferably about 1 wt. % to about 8 wt. %, of at least one solubilizing agent which is a $C_{2-5}$ mono, dihydroxy or polyhydroxy alkanols such as ethanol, isopropanol, glycerol ethylene glycol, diethylene glycol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %.

The cosurfactant may play an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized.

Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity. Generally, an increase in cosurfactant concentration results in a wider temperature range of the stability of the product.

The major class of compounds found to provide highly suitable cosurfactants for the microemulsion over temperature ranges extending from 5° C. to 43° C. for instance are water-soluble polyethylene glycols having a molecular weight of 150 to 1000, polypropylene glycol of the formula $HO(CH_3CHCH_2O)_nH$ wherein n is a number from 2 to 18, mixtures of polyethylene glycol and polypropylene glycol (Synalox) and mono and di $C_1$–$C_6$ alkyl ethers and esters of ethylene glycol and propylene glycol having the structural formulas $R(X)_nOH$, $R_1(X)_nOH$, $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. When these glycol type cosurfactants are at a concentartion of about 1.0 to about 14 weight %, more preferably about 2.0 weight % to about 10 weight % in combination with a water insoluble hydrocarbon which is at a concentration of at least 0.5 weight %, more preferably 1.5 weight % one can form a microemulsion composition.

While all of the aforementioned glycol ether compounds provide the described stability, the most preferred cosurfactant compounds of each type, on the basis of cost and cosmetic appearance (particularly odor), are dipropylene glycol monomethyl ether and diethylene glycol monobutyl ether. Other suitable water soluble cosurfactants are water soluble esters such as ethyl lactate and water soluble carbohydrates such as butyl glycosides.

The amount of cosurfactant required to stabilize the microemulsion compositions will, of course, depend on such factors as the surface tension characteristics of the cosurfactant, the type and amounts of the primary surfactants and water insoluble hydrocarbon, and the type and amounts of any other additional ingredients which may be present in the composition and which have an influence on the thermodynamic factors enumerated above. Generally, amounts of cosurfactant in the range of from 1% to 14%, preferably from about 2 wt. % to 10 wt. % provide stable dilute o/w microemulsions for the above-described levels of primary surfactants and water insoluble hydrocarbon and any other additional ingredients as described below.

The ability to formulate mild, acid or neutral products without builders which have grease removal capacities is a feature of the present invention because the prior art o/w microemulsion formulations most usually are highly alkaline or highly built or both.

The instant microemulsion formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The final essential ingredient in the inventive microemulsion compositions having improved interfacial tension properties is water. The proportion of water in the microemulsion compositions generally is in the range of 35% to 65%, preferably 40% to 60% by weight of the usual diluted o/w microemulsion composition.

In final form, the instant compositions exhibit stability at reduced and increased temperatures. More specifically, such compositions remain clear and stable in the range of 5° C.

to 50° C., especially 10° C. to 43° C. Such compositions exhibit a pH of 5 to 8. The liquid microemulsion compositions are readily pourable and exhibit a viscosity in the range of 6 to 300 milliPascal . second (mPas.) as measured at 25° C. with a Brookfield RVT Viscometer using a #1 spindle rotating at 20 RPM. Preferably, the viscosity is maintained in the range of 10 to 200 mPas.

The instant compositions have a minimum foam height of 110 mis after 55 rotations at 40° C. as measured by the foam volume test using 0.75 grams of the composition per liter of water and 1 gram of corn oil per liter of water having a hardness of 300 ppm.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | E | F | G | H |
|---|---|---|---|---|---|---|---|---|
| $C_{14-16}$ Paraffin sulfonate sodium salt | 14 | 14 | 14 | 14 | 14 | 14 | 14 | 14 |
| $C_{13-14}$ AEOS 2:1 EO | 3 | 3 | 3 | 3 | 3 | 3 | 3 | 3 |
| $C_{12-14}$ Alkyl betaine | — | — | — | — | — | — | — | — |
| Cocoamido propyl betaine | 5 | 5 | 5 | 5 | 5 | 5 | 5 | 5 |
| Nonionic $C_{9-11}$ 7.5–8 EO | 12 | 12 | 12 | 12 | 12 | 12 | 12 | 12 |
| Ethanol | 3.3 | 3.3 | 4.3 | 4 | 3.3 | 3.3 | 3.3 | 3.9 |
| Urea | 2.4 | 2.4 | 2.4 | 2.4 | 2.4 | 2.4 | 2.4 | 2.4 |
| Terpineol | 5 | — | 8 | 6 | 8 | 8 | 8 | 8 |
| Limonene | — | 5 | — | — | — | — | — | — |
| Isopropanol | — | — | — | — | 2 | — | 4 | 2 |
| Dipropylene glycol monomethyl ether | 6 | 6 | 6 | 7 | 6 | 6 | 6 | 6 |
| Propylene glycol | — | — | — | — | — | 2 | — | — |
| Minors | 1 | 1 | 1 | 1 | 1 | 1 | 1 | 1 |
| Water | 48.3 | 48.3 | 44.3 | 45.6 | 43.3 | 43.3 | 41.3 | 42.7 |
| Appearance @ RT | OK | OK | OK | OK | OK | OK | OK | OK |
| Appearance @ 4C | OK | OK | OK | OK | OK | OK | OK | OK |
| Brookfield | 120 | 70 | 60 | 30 | 20 | 50 | | |
| Flash Point (° C.) | | | 53 | | 48 | | 41 | 46 |
| Olive oil emulsification speed (in sec.) | 130 | 100 | 40 | 105 | 96 | 110 | | |
| Suds titration | 4.4 | 4.1 | 5.3 | 4.8 | 5.4 | 5.8 | | |

| | I | J | K | L | M | N | O | P | Q |
|---|---|---|---|---|---|---|---|---|---|
| $C_{14-16}$ Paraffin sulfonate sodium salt | 14 | 14 | 17.3 | 17.3 | 17.3 | 17.3 | 17.3 | 20.6 | 20.6 |
| $C_{13-14}$ AEOS 2:1 EO | 3 | 3 | 3.7 | 3.7 | 3.7 | 3.7 | 3.7 | 4.4 | 4.4 |
| $C_{12-14}$ Alkyl betaine | — | — | — | — | — | — | — | — | — |
| Cocoamido propyl betaine | 5 | 5 | 5 | 5 | 5 | 5 | 5 | 5 | 5 |
| Nonionic $C_{9-11}$ 7.5–8 EO | 12 | 12 | 8 | 8 | 8 | 8 | 8 | 4 | 4 |
| Ethanol | 3.3 | 3.6 | 3.6 | 3.6 | 3.9 | 3.6 | 3.3 | 3.6 | 3.9 |
| Urea | 2.4 | 2.4 | 2.4 | 2.4 | 2.4 | 2.4 | 5 | 2.4 | 2.4 |
| Terpineol | 5 | 5 | 5 | 5 | 5 | 5 | 5 | 5 | 5 |
| Limonene | — | — | — | — | — | — | — | — | — |
| Isopropanol | — | — | 2 | 4 | 2 | — | — | — | 2 |
| Dipropylene glycol monomethyl ether | 6 | 6 | 6 | 6 | 6 | 6 | 6 | 6 | 6 |
| Propylene glycol | — | — | — | — | — | 2 | — | 2 | — |
| Minors | 1 | 1 | 1 | 1 | 1 | 1 | 1 | 1 | 1 |
| Water | 48.3 | 48 | 46 | 44 | 45.7 | 46 | 45.7 | 46 | 45.7 |
| Appearance @ RT | OK | OK | OK | OK | OK | OK | OK | OK | OK |
| Appearance @ 4C | OK | OK | OK | OK | OK | OK | OK | OK | OK |
| Brookfield | 120 | 50 | 30 | 25 | 35 | 20 | 30 | 35 | 35 |
| Flash Point (° C.) | | | 49 | 40 | 42 | 59 | 61 | | 45 |
| Olive oil emulsification speed (in sec.) | 130 | 80 | 95 | 120 | 115 | 120 | 110 | 105 | |
| Suds titration | 4.4 | 4.3 | 5.6 | 5.4 | 6.1 | | | 5.9 | |

| | R | S | T | U | V | W | X | Y | Z |
|---|---|---|---|---|---|---|---|---|---|
| $C_{14-16}$ Paraffin sulfonate sodium salt | 17.3 | 17.3 | 17.3 | 17.3 | 17.3 | 17.3 | 17.3 | 17.3 | 17.3 |
| $C_{13-14}$ AEOS 2:1 EO | 3.7 | 3.7 | 3.7 | 3.7 | 3.7 | 3.7 | 3.7 | 3.7 | 3.7 |
| $C_{12-14}$ Alkyl betaine | — | — | — | — | 5 | 5 | — | 4 | 4 |
| Cocoamido propyl betaine | 5 | 5 | 5 | 5 | — | — | 5 | — | — |
| Nonionic $C_{9-11}$ 7.5–8 EO | 8 | 8 | 8 | 8 | 8 | 8 | 8 | 9 | 9 |
| Ethanol | 2 | 0 | 3.3 | 3.3 | 3.3 | 3.3 | 3.3 | 3.3 | 3.3 |
| Urea | 5 | 5 | 5 | 5 | — | 2.4 | 5 | 7 | 5 |
| Terpineol | 5 | 5 | 5 | 5 | 5 | 5 | 5 | 5 | 5 |
| Limonene | — | — | — | — | — | — | — | — | — |
| Isopropanol | — | — | — | — | — | — | — | — | — |
| DEGMBE | — | — | — | — | 8 | 5.6 | — | — | 1 |
| Dipropylene glycol monomethyl ether | 6 | 6 | 6 | 6 | 6 | 6 | 6 | 6 | 6 |
| Propylene glycol | — | — | — | — | — | — | — | — | — |
| Minors | 1 | 1 | 1 | 1 | 1 | 1 | 1 | 1 | 1 |
| Water | 47 | 48 | 45.7 | 45.7 | 42.7 | 42.7 | 45.7 | 43.7 | 44.7 |
| Appearance @ RT | OK | OK | OK | OK | OK | OK | OK | OK | OK |

-continued

| | | | | | | | | | |
|---|---|---|---|---|---|---|---|---|---|
| Appearance @ 4C | OK | OK | OK | OK | OK | OK | OK | OK | OK |
| Brookfield | 10 | 10 | 30 | 30 | | | 30 | 35 | |
| Flashpoint (° C.) | | | 61 | 61 | | | 61 | | |
| Olive oil emulsification speed (in sec.) | 146 | 140 | 120 | 120 | | | 120 | | |
| Suds titration | 16 | | | | | | | 5.2 | |

EXAMPLE 2

The following compositions in wt. % were prepared by simple mixing procedure:

| | A | B | C | D | E | F | G | H |
|---|---|---|---|---|---|---|---|---|
| $C_{14-16}$ Paraffin sulfonate sodium salt | 17.3 | 17.3 | 17.3 | 17.3 | 17.3 | 17.3 | 17.3 | 17.3 |
| $C_{13-14}$ AEOS 2:1 EO | 3.7 | 3.7 | 3.7 | 3.7 | 3.7 | 3.7 | 3.7 | 3.7 |
| $C_{12-14}$ Alkyl betaine | — | — | — | — | — | — | — | — |
| Cocoamido propyl betaine | 5 | 5 | 5 | 5 | 5 | 5 | 5 | 5 |
| Nonionic $C_{9-11}$ 7.5–8 EO | 6 | 6 | 6 | 6 | 6 | 6 | 6 | 6 |
| LMMEA | 2 | 2 | 2 | 2 | 2 | 2 | 2 | 2 |
| Ethanol | 1 | 1 | 1 | 2 | 1 | 1 | 1 | 1 |
| Urea | 5 | 5 | 5 | 5 | 5 | 5 | 5 | 5 |
| Terpineol | — | 4 | — | — | — | 4 | — | — |
| Limonene | 5 | — | — | — | — | — | 4 | — |
| Alpha Pinene | — | — | 4 | — | — | — | — | — |
| Beta Pinene | — | — | — | 4 | — | — | — | — |
| Isobornyl Acetate | — | — | — | — | 4 | — | — | — |
| Phenoxyethanol | — | — | — | — | — | — | — | 4 |
| Isopropanol | — | — | — | — | — | — | — | — |
| DEGMBE | — | 1 | — | — | — | — | — | — |
| PEG 400 | 2 | — | — | — | — | — | — | — |
| Dipropylene glycol monomethyl ether | 4 | 5 | 6 | 6 | 6 | 6 | 6 | 6 |
| Propylene glycol | — | — | — | — | — | — | — | — |
| Minors | 1 | 1 | 1 | 1 | 1 | 1 | 1 | 1 |
| Water | 49 | 49 | 49 | 48 | 49 | 49 | 49 | 49 |
| Appearance @ RT | ok | ok | ok | ok | ok | ok | ok | ok |
| Appearance @ 4C | ok | ok | ok | ok | hazy | ok | ok | ok |
| Brookfield | 80 | 70 | 100 | 70 | 70 | 50 | 90 | 70 |
| Flash Point (° C.) | — | — | 40.5 | 43.5 | >90 | — | 57 | >90 |
| Olive oil emulsification speed (in sec.) | — | — | 66 | 62 | 52 | 64 | 55 | 84 |
| Suds titration | — | — | 5.9 | 4.4 | 5.4 | 4.8 | 5.3 | — |

| | I | J | K | L | M |
|---|---|---|---|---|---|
| $C_{14-16}$ Paraffin sulfonate sodium salt | 17.3 | 17.3 | 17.3 | 17.3 | 17.3 |
| $C_{14-14}$ AEOS 2:1 EO | 3.7 | 3.7 | 3.7 | 3.7 | 3.7 |
| $C_{12-14}$ Alkyl betaine | — | — | — | — | — |
| Cocoamido propyl betaine | 5 | 5 | 5 | 5 | 5 |
| Nonionic $C_{9-11}$ 7.5–8 EO | 6 | 6 | 6 | 6 | 6 |
| LMMEA | 2 | 2 | 2 | 2 | 2 |
| Ethanol | 1 | 1 | 1 | 1 | 1 |
| Urea | 5 | 5 | 5 | 5 | 5 |
| Benzylalcohol | 4 | — | — | — | — |
| Isononylacetate | — | 4 | — | — | — |
| Terpinolene | — | — | 4 | — | — |
| Dicylcopentadienylacetate | — | — | — | 4 | — |
| Benzylacetate | — | — | — | — | 4 |
| Dipropylene glycol monomethyl ether | 6 | 6 | 6 | 6 | 6 |
| Minors | 1 | 1 | 1 | 1 | 1 |
| Water | 49 | 49 | 49 | 49 | 49 |
| Appearance @ RT | ok | ok | ok | ok | ok |
| Appearance @ 4C | ok | hazy | ok | ok | ok |
| Brookfield | 50 | 50 | 70 | — | — |
| Flash Point (° C.) | >90 | 65 | 62 | — | — |
| Olive oil emulsification speed (in sec.) | 89 | 46 | 60 | 60 | 66 |
| Suds titration | — | — | 4.8 | — | — |

EXAMPLE 3

The following compositions in ai. % were prepared by simple mixing the different ingredients with deionized water:

| | A | B | C | D | E | F | G | H |
|---|---|---|---|---|---|---|---|---|
| Paraffin sulfonate | 17.3 | 17.3 | 17.3 | 17.3 | 17.3 | 17.3 | 17.3 | 17.3 |
| AEOS | 3.7 | 3.7 | 3.7 | 3.7 | 3.7 | 3.7 | 3.7 | 3.7 |
| Alkyl betaine | — | — | — | — | — | — | — | — |
| Cocoamido propyl betaine | 5 | 5 | 5 | 5 | 5 | 5 | 5 | 5 |
| Nonionic | 6 | 6 | 6 | 6 | 6 | 6 | 6 | 6 |
| LMMEA | 2 | 2 | 2 | 2 | 2 | 2 | 2 | 2 |
| Ethanol | 1 | 1 | 1 | 1 | 1 | 1 | 1 | 1 |
| Urea | 5 | 5 | 5 | 5 | 5 | 5 | 5 | 5 |
| Terpineol | — | — | — | — | — | — | — | — |
| Limonene | 3 | 0 | 3 | 0 | 3 | 0 | 3 | 0 |
| Alpha Pinene | — | — | — | — | 1 | 4 | — | — |
| Beta Pinene | — | — | 1 | 4 | — | — | — | — |
| Isobornyl Acetate | — | — | — | — | — | — | 1 | 4 |
| Terp inolene | 1 | 4 | — | — | — | — | — | — |
| Dipropylene glycol monomethyl ether | 6 | 6 | 6 | 6 | 6 | 6 | 6 | 6 |
| Propylene glycol | — | — | — | — | — | — | — | — |
| Minors | 1 | 1 | 1 | 1 | 1 | 1 | 1 | 1 |
| Water | | | | up to 100% | | | | |
| Appearance @ RT | ok | ok | ok | ok | ok | ok | ok | ok |
| Appearance @ 4C | — | — | — | — | — | — | — | — |
| Brookfield | — | — | — | — | — | — | — | — |
| Flash Point (° C.) | — | 62 | — | 44 | 51 | 41 | 61 | >90 |
| Olive oil emulsification speed (in sec.) | 64 | 57 | 52 | 65 | 58 | 73 | 53 | 53 |
| Suds titration | — | — | — | — | — | — | — | — |

| | I | J | K | L | M | N | O | P | Q |
|---|---|---|---|---|---|---|---|---|---|
| Paraffin sulfonate | 17.3 | 17.3 | 17.3 | 17.3 | 17.3 | 17.3 | 17.3 | | |
| AEOS | 3.7 | 3.7 | 3.7 | 3.7 | 3.7 | 3.7 | 3.7 | | |
| Alkyl betaine | — | — | — | — | — | — | — | | |
| Cocoamido propyl betaine | 5 | 5 | 5 | 5 | 5 | 5 | 5 | | |
| Nonionic | 6 | 6 | 6 | 6 | 6 | 6 | 6 | | |
| LMMEA | 2 | 2 | 2 | 2 | 2 | 2 | 2 | | |
| Ethanol | 1 | 1 | 1 | 1 | 1 | 1 | 1 | | |
| Urea | 5 | 5 | 5 | 5 | 5 | 5 | 5 | | |
| Limonene | 3 | 0 | 3 | 0 | 2 | 0 | 1 | | |
| Terpinolene | — | — | — | — | — | — | — | | |
| Dicyclopentadienylacetate | — | — | 1 | 4 | — | — | — | | |
| Benzylacetate | 1 | 4 | | | | | | | |
| Litsea Cubeba oil | — | — | — | — | 2 | 4 | 3 | | |
| Dipropylene glycol monomethyl ether | 6 | 6 | 6 | 6 | 6 | 6 | 6 | | |
| Minors | 1 | 1 | 1 | 1 | 1 | 1 | 1 | | |
| Water | | | | up to 100% | | | | | |
| Appearance @ RT | ok | ok | ok | ok | ok | ok | ok | | |
| Appearance @ 4C | — | — | — | — | ok | ok | ok | | |
| Brookfield | — | — | — | — | — | — | — | | |
| Flash Point (° C.) | 61 | >90 | 61 | >90 | 55 | 54 | — | | |
| Olive oil emulsification speed (in sec.) | 55 | 66 | 56 | 62 | 58 | 53 | 53 | | |
| Suds titration | — | — | — | — | — | — | — | | |

EXAMPLE 4

The following compositions in ai. % were prepared by simple mixing the different ingredients with deionized water:

| | A | B | C | D |
|---|---|---|---|---|
| Paraffin sulfonate | 17.3 | 17.3 | 17.3 | 17.3 |
| AEOS | 3.7 | 3.7 | 3.7 | 3.7 |
| Alkyl betaine | — | — | — | — |
| Cocoamido propyl betaine | 5 | 5 | 5 | 5 |
| Nonionic | G | 6 | 6 | 6 |
| LMMEA | 2 | 2 | 2 | 2 |
| Ethanol | 1 | 1 | 1 | 1 |
| Urea | 5 | 5 | 5 | 5 |
| Terpineol | 1 | — | — | — |
| Limonene | 2 | 2 | 2 | 2 |
| Alpha Pinene | 1 | 1 | 1 | 1 |
| Isobornyl Acetate | — | — | — | 1 |
| Dicyclopentadienylacetate | — | 1 | — | — |

-continued

| | A | B | C | D |
|---|---|---|---|---|
| Benzylacetate | — | — | 1 | — |
| Dipropylene glycol monomethyl ether | 6 | 6 | 6 | 6 |
| Minors | 1 | 1 | 1 | 1 |
| Water | | up to 100% | | |
| Appearance @ RT | ok | ok | ok | ok |
| Appearance @ 4C | ok | ok | ok | ok |
| Brookfield | — | — | — | — |
| Flash Point (° C.) | 55 | 55 | 55 | 55 |
| Olive oil emulsification speed (in sec.) | 53 | 57 | 50 | 56 |
| Suds titration | 4.8 | 4.8 | 4.8 | 4.9 |

EXAMPLE 5

The following compositions in wt. % were prepared by simple mixing procedure:

| | A | B | C | D | E | F | G |
|---|---|---|---|---|---|---|---|
| $C_{14-16}$ Paraffin sulfonate sodium salt | 17.3 | 17.3 | 17.3 | 17.3 | 17.3 | 17.3 | 17.3 |
| $C_{13-14}$ AEOS 2:1 EO | 3.7 | 3.7 | 3.7 | 3.7 | 3.7 | 3.7 | 3.7 |
| Cocamido propyl betaine | 5 | 5 | 5 | 5 | 5 | 5 | 5 |
| Nonionic $C_{9-11}$ 7.5–8 EO | 6 | 6 | 6 | 6 | 6 | 6 | 6 |
| LMMEA | 2 | 2 | 2 | 2 | 2 | 2 | 2 |
| Ethanol | 2 | 2 | 2 | 2 | 2 | 2 | 2 |
| Urea | 5 | 5 | 5 | 5 | 5 | 5 | 5 |
| 2-methyl-1,3-dioxolane | 4 | | | | | | |
| 1,3-dimethyl-cyclohexane | | 4 | | | | | |
| nitrobenzene | | | 4 | | | | |
| 3-morpholino-1,2-propanediol | | | | 4 | | | |
| butylbenzene | | | | | 4 | | |
| isobutyl isobutyrate | | | | | | 4 | |
| 4-bromotoluene | | | | | | | 4 |
| Dipropylene glycol monomethyl ether | 6 | 6 | 6 | 6 | 6 | 6 | 6 |
| Propylene glycol | | | | | | | |
| Minors | 1 | 1 | 1 | 1 | 1 | 1 | 1 |
| Water | 48 | 48 | 48 | 48 | 48 | 48 | 48 |
| Appearance @ RT | ok | ok | ok | ok | ok | ok | ok |
| Appearance @ 4C | ok | ok | ok | ok | ok | ok | ok |
| Brookfield | 80 | 80 | 105 | 85 | 80 | 70 | 80 |
| Flash Point (° C.) | — | — | — | — | — | — | — |
| Olive oil emulsification speed (in sec.) | 190 | 282 | 131 | 374 | 124 | 102 | 199 |
| Suds titration | 4.6 | 4.8 | 4.8 | 4.6 | 4.7 | 4.7 | 4.4 |

What is claimed:

1. A clear microemulsion light duty liquid cleaning composition which comprises approximately by weight:

(a) 14% to 24% of an alkali metal salt of an anionic sulfonate surfactant;

(b) 2% to 6% of an alkali metal salt of a C8-18 ethoxylated alkyl ether sulfate;

(c) 2% to 8% of a betaine surfactant;

(d) 4% to 12% of a nonionic surfactant;

(e) 1% to 10% of at least one solubilizing agent;

(f) 1% to 14% of a cosurfactant;

(g) 0 to 10% of a supplemental solubilizing agent;

(h) 1% to 8% of water insoluble heterocyclic compounds selected from the group consisting of 2,5-dimethylhydrofuran, 2-methyl-1,3-dioxolane, 2-ethyl-2-methyl 1,3 dioxolane, 3-ethyl 4-propyl tetrahydropyran, 3-morpholino-1,2-propanediol and N-isopropyl morpholine; and (i) the balance being water; wherein the composition does not contain a nitrogenous buffer selected from the group consisting of ammonium or alkaline carbonates, quanidine derivatives, alkoxyl alkylamines, and alkyleneamines, and a grease release agent which is an ethoxylated maleic anhydride-alpha-olefin copolymer having a comblike structure with both hydrophobic and hydrophilic chains and the copolymer is characterized by the formula:

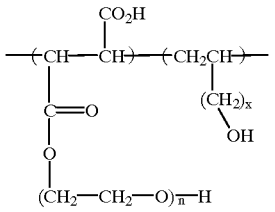

wherein n is about 5 to about 14, x is about 7 to 19, and y is of such a value as to provide a molecular weight about 10,000 to about 30,000 and the composition has a minimum foam height of 110 mls after 55 rotations at 40° C. using 0.75 grams of the composition per liter of water and 1 gram of corn oil per liter of water having a hardness of 300 ppm.

2. The composition of claim 1, wherein said solubilizing agent is a $C_{2-5}$ mono,di or polyhydroxy alkanol.

3. The composition of claim 1, wherein said solubilizing agent is selected from the group consisting of isopropanol, ethanol, glycerol, ethylene glycol, diethylene glycol, propylene glycol and mixtures thereof.

4. The composition of claim 3, wherein said supplemental solubilizing agent is urea.

5. The composition of claim 1, wherein said cosurfactant is selected from the group consisting of polyethylene glycols having a molecular weight of 150 to 1000, polypropylene glycol of the formula $HO((CH_3)CHCH_2O)_nH$, wherein n is 2 to 18, polyethylene and propylene glycol ethers and esters having the formula of R(X)nOH, R1(X)nOH, R(X)nOR, R(X)nOR1, R1(X)nOR and R1(X)nOR1wherein R is a C1–6 alkyl group, R1 is a C1–6 acyl group, X is (OCH2CH2) or (OCH2CHCH3) and n is from 1 to 8 and mixtures thereof.

6. The composition of claim 2, wherein said cosurfactant is selected from the group consisting of polyethylene glycols having a molecular weight of 150 to 1000, polypropylene glycol of the formula $HO((CH_3)CHCH_2O)nH$, wherein n is 2 to 18, polyethylene and propylene glycol ethers and esters having the formula of R(X)nOH, R1(X)nOH, R(X)nOR, R(X)nOR1, R1(X)nOR and R1(X)nOR1wherein R is a C1–6 alkyl group, R1 is a C1–6 acyl group, X is (OCH2CH2) or (OCH2CHCH3) and n is from 1 to 8 and mixtures thereof.

7. The composition of claim 1, wherein said cosurfactant is dipropylene glycol monomethyl ether.

8. The composition of claim 1, wherein said cosurfactant is diethylene glycol monobutyl ether.

9. The composition of claim 1, further including an alkyl monoalkanol amide and/or an alkyl dialkanol amide.

* * * * *